US008113865B1

(12) United States Patent
Yang et al.

(10) Patent No.: US 8,113,865 B1
(45) Date of Patent: Feb. 14, 2012

(54) PLUG CONNECTOR

(75) Inventors: Chih-Lin Yang, Taipei (TW); Sheng-Nan Yu, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 42 days.

(21) Appl. No.: 12/870,218

(22) Filed: Aug. 27, 2010

(51) Int. Cl.
*H01R 13/627* (2006.01)

(52) U.S. Cl. ..... 439/353; 439/607.55

(58) Field of Classification Search ..... 439/607.41, 439/607.47, 607.48, 607.5, 607.51, 607.55–607.58, 439/607.35, 607.54, 353
See application file for complete search history.

(56) References Cited

U.S. PATENT DOCUMENTS

| | | | | |
|---|---|---|---|---|
| 7,465,194 | B1 * | 12/2008 | Ho et al. | 439/607.01 |
| 7,690,948 | B2 * | 4/2010 | Lung | 439/607.27 |
| 7,717,733 | B1 * | 5/2010 | Yi et al. | 439/452 |
| 7,794,279 | B1 * | 9/2010 | Ye et al. | 439/607.54 |
| 7,815,470 | B2 * | 10/2010 | Ho | 439/607.48 |
| 7,833,058 | B2 * | 11/2010 | Zhang et al. | 439/607.41 |
| 7,845,965 | B2 * | 12/2010 | Ko | 439/352 |
| 7,931,501 | B1 * | 4/2011 | Chiang | 439/607.35 |
| 2008/0200058 | A1 * | 8/2008 | Tsai | 439/353 |
| 2009/0275235 | A1 * | 11/2009 | Shi et al. | 439/607.58 |
| 2009/0280687 | A1 * | 11/2009 | Liu et al. | 439/607.55 |
| 2009/0325417 | A1 * | 12/2009 | Ko | 439/350 |
| 2010/0062642 | A1 * | 3/2010 | Zhang et al. | 439/607.41 |
| 2010/0184338 | A1 * | 7/2010 | Hou et al. | 439/660 |
| 2010/0233907 | A1 * | 9/2010 | Wu | 439/607.58 |
| 2011/0195609 | A1 * | 8/2011 | Su et al. | 439/660 |
| 2011/0281464 | A1 * | 11/2011 | Hou | 439/607.55 |
| 2011/0281465 | A1 * | 11/2011 | Hou | 439/607.55 |

* cited by examiner

*Primary Examiner* — Ross Gushi
(74) *Attorney, Agent, or Firm* — WPAT, P.C.; Anthony King

(57) ABSTRACT

A plug connector includes an insulating housing having a base body and a tongue portion protruded forwards from the base body, a propping lid which has a base block mounted to a rear of the base body and two insertion bolts protruded forwards from two opposite ends of a front face of the base block with a locking bump protruded at a front of an outside thereof, and a shielding shell having a casing sleeved to the tongue portion. A pair of fastening cavities is opened at two opposite sides of the base body for receiving the insertion bolts therein. The casing has two opposite side strips each elongated rearwards to form a clamping arm with a rear being provided with a locking hole. The clamping arm is inserted into the fastening cavity and coupled with the insertion bolt via the locking bump buckled in the locking hole.

6 Claims, 2 Drawing Sheets

PLUG CONNECTOR

BACKGROUND OF THE INVENTION

1. Field of the Invention

The present invention relates to a plug connector, and particularly to a plug connector including an insulating housing, a shielding shell and a propping lid which can be assembled together firmly.

2. The Related Art

Plug connectors are generally provided with shielding shells for avoiding electromagnetic interference. The conventional plug connector further includes an insulating housing, a plurality of terminals and a propping lid. The insulating housing has a rectangular base body and a tongue portion protruded forwards from a front of the base body. The terminals are mounted in the insulating housing for electrically connecting with a mating socket connector. The propping lid is located at a rear of the base body of the insulating housing to secure the terminals in the insulating housing. Generally speaking, the shielding shell has a casing sleeved to the tongue portion. The casing defines two opposite side plates, of which each is elongated rearwards to form a long clamping arm. The clamping arm passes through the insulating housing and projects beyond the rear of the base body to be coupled with the propping lid, so as to secure the shielding shell, the insulating housing and the propping lid together. However, it causes the shielding shell to have an over-lengthy clamping arm, so that needs to take more material sources for the shielding shell, and furthermore, is unfavorable to economize manufacture cost of the plug connector.

SUMMARY OF THE INVENTION

Accordingly, an object of the present invention is to provide a plug connector. The plug connector includes an insulating housing having a base body and a tongue portion protruded forwards from a front of the base body, a plurality of terminals disposed in the insulating housing respectively, a propping lid having a base block and a pair of insertion bolts protruded forwards from two opposite ends of a front face of the base block, and a shielding shell having a casing sleeved to the tongue portion of the insulating housing. A pair of fastening cavities is opened at two opposite sides of the base body and each extends longitudinally to penetrate through the base body. A locking bump is protruded at a front of an outside of the insertion bolt. The base block is mounted to a rear of the base body of the insulating housing to secure the terminals in the insulating housing. The insertion bolts are inserted in the corresponding fastening cavities. The casing has a top plate, a bottom plate facing the top plate, and two opposite side strips connecting the top plate and the bottom plate. Each of the side strips is elongated rearwards to form a clamping arm with a rear being provided with a locking hole. The clamping arm is inserted into a front of the corresponding fastening cavity to be coupled with the corresponding insertion bolt of the propping lid by means of the locking bump buckled in the locking hole.

As described above, the propping lid has the insertion bolt protruded from the base block to be inserted in the corresponding fastening cavity of the insulating housing, and then the clamping arm of the shielding shell is coupled with the corresponding insertion bolt by means of the locking bump buckled in the locking hole. Such structures are excellent to shorten the clamping arm, and furthermore, economize manufacture cost of the plug connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
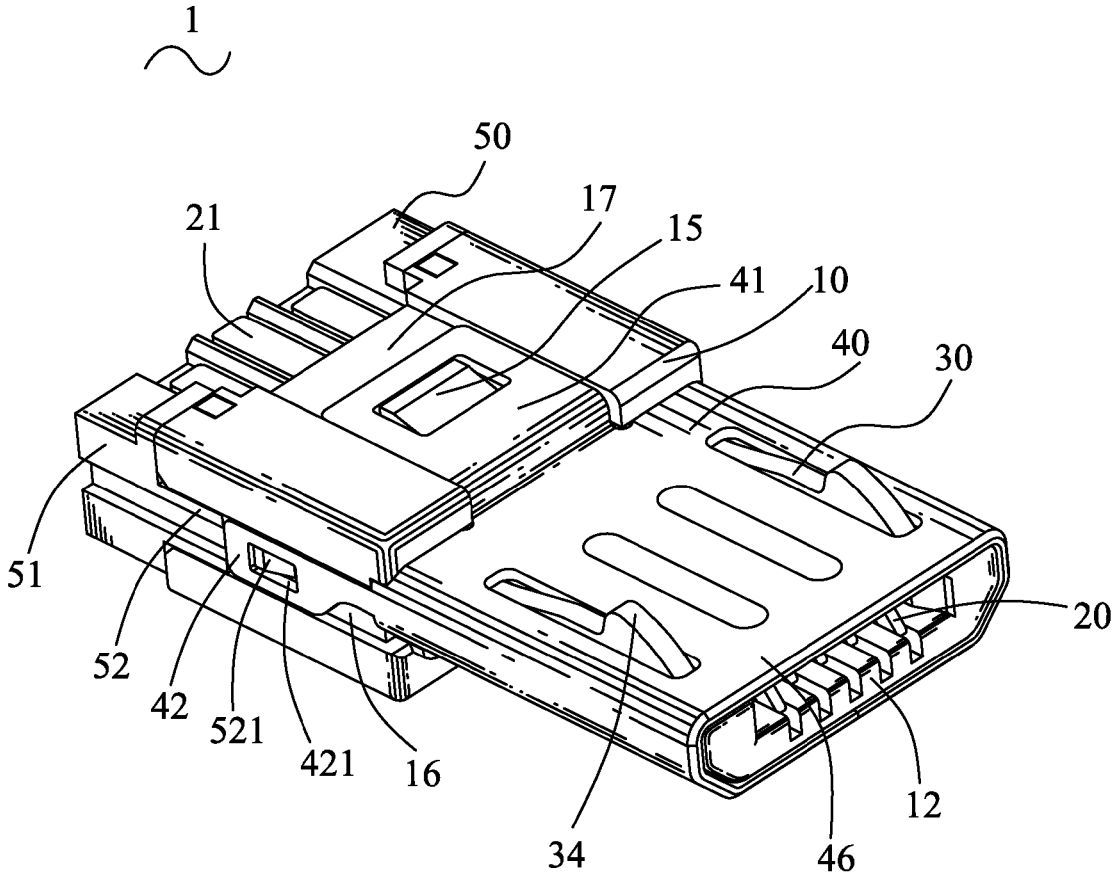
FIG. 1 is an assembled perspective view of a plug connector in accordance with the present invention.

Referring to the drawings in greater detail, and first to FIG. 1, the embodiment of the invention is embodied in a plug connector 1. The plug connector 1 includes an insulating housing 10, a plurality of terminals 20 and a pair of latches 30 mounted to the insulating housing 10 respectively, a propping lid 50 mounted at a rear of the insulating housing 10, and a shielding shell 40 coupled with the insulating housing 10.

Figure 2:
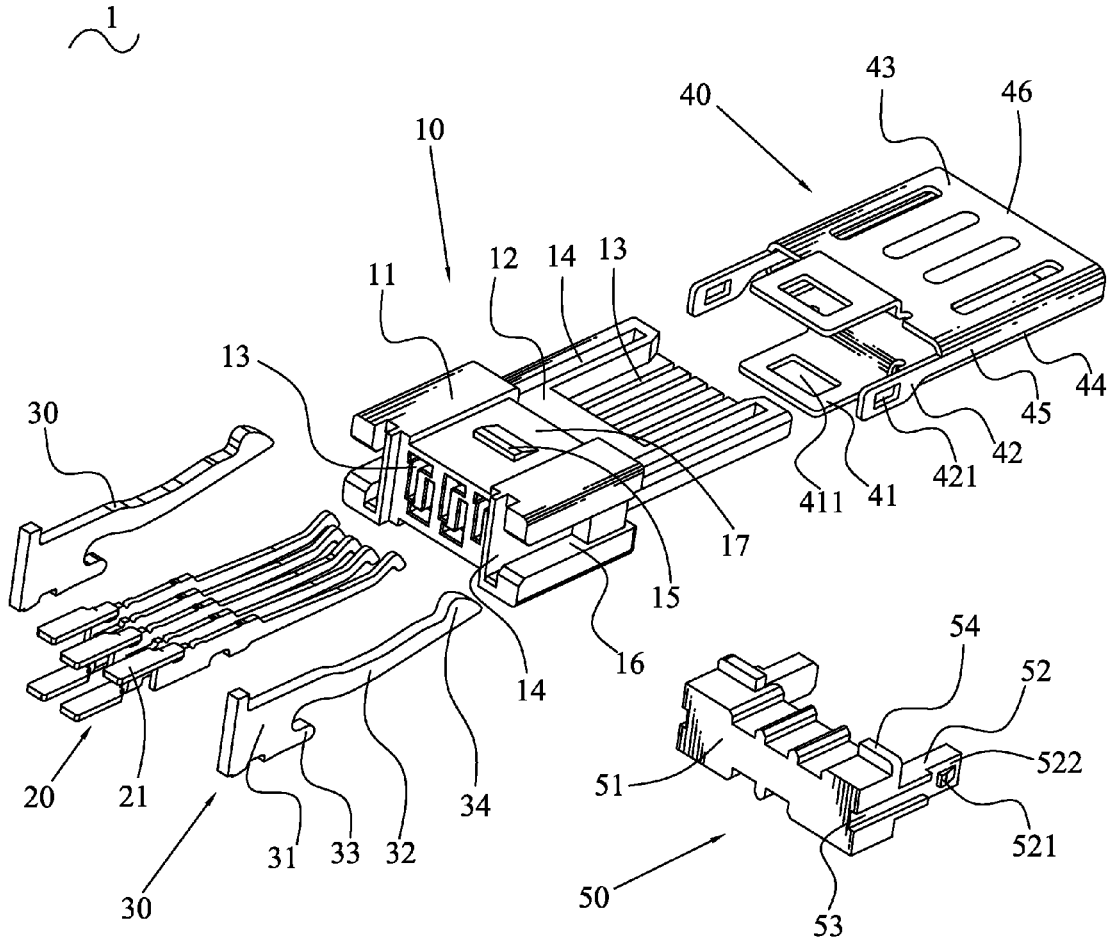
FIG. 2 is an exploded perspective view of the plug connector of FIG. 1.

With reference to FIG. 2, the insulating housing 10 has a rectangular base body 11 and a tongue portion 12 protruded forwards from a middle of a front surface of the base body 11 for being inserted into a mating socket connector (not shown) along a front-to-rear direction. The base body 11 has two indentation areas 17 oppositely provided at middles of top and bottom surfaces thereof. The indentation area 17 is enlarged to the front surface of the base body 11. A wedge 15 is formed at a center of each indentation area 17. A top of the tongue portion 12 defines a plurality of terminal grooves 13 arranged at regular intervals along a transverse direction thereof and each extending longitudinally to penetrate through the base body 11. The insulating housing 10 further defines a pair of receiving slots 14 located at two outmost sides of the terminal grooves 13 and each extending longitudinally to penetrate through the base body 11 and the top of the tongue portion 12. A pair of fastening cavities 16 is opened at substantial middles of two opposite sides of the base body 11, and each extends longitudinally to penetrate through the base body 11 with a rear thereof being closer to the corresponding receiving slot 14 than a front thereof. In this embodiment, the rear of the fastening cavity 16 is connected with the corresponding receiving slot 14. Each of the latches 30 has a fastening board 31, an elastic arm 32 extending forward from a top of a front edge of the fastening board 31, and a first positioning portion 33 protruded forward from a bottom of the front edge of the fastening board 31. The elastic arm 32 is slightly inclined upward and has a free end protruded upward to form a locking barb 34.

Referring to FIG. 2 again, the propping lid 50 has a substantially rectangular base block 51 and a pair of insertion bolts 52 protruded forwards from substantial middles of two opposite ends of a front face of the base block 51. The insertion bolt 52 has a receiving recess 522 freely opened at a front end of an outside thereof. A locking bump 521 is protruded at a substantial center of the receiving recess 522. Two opposite sides of the base block 51 are concaved inward to form a pair of positioning fillisters 53 extending along the extending direction of the insertion bolt 52 to the corresponding insertion bolts 52, for facilitating the propping lid 50 to be mounted to the insulating housing 10. Two second positioning portions 54 are protruded at a top of the base block 51 and spaced from each other.

In FIG. 2, the shielding shell 40 has a rectangular casing 46 for enclosing the tongue portion 12 of the insulating housing 10 therein. The casing 46 has a top plate 43, a bottom plate 44 facing the top plate 43, and two opposite side strips 45 connecting the top plate 43 and the bottom plate 44. Middles of rear edges of the top plate 43 and the bottom plate 44 are oppositely bent perpendicularly to the top plate 43 and the bottom plate 44, and then extend rearwards to form a pair of buckling slices 41. A buckling opening 411 is opened at a center of each of the buckling slices 41. Each of the side strips 45 is elongated rearwards to form a clamping arm 42, with a rear being provided with a locking hole 421.

Referring to FIG. 1 and FIG. 2 again, in assembly, the terminals 20 are disposed in the corresponding terminal grooves 13 of the insulating housing 10 and have soldering tails 21 thereof projected behind the base body 11. The latches 30 are inserted forwards in the corresponding receiving slots 14, and the locking barbs 34 elastically project upwards out of the respective receiving slots 14. The propping lid 50 is mounted to a rear of the base body 11, wherein the base block 51 abuts against a rear surface of the base body 11 to secure the terminals 20 and the latches 30 in the insulating housing 10, and the insertion bolts 52 are inserted in the rears of the fastening cavities 16 with the receiving recesses 522 being in alignment with the fronts of the corresponding fastening cavities 16. The soldering tails 21 of the terminals 20 are against a top and a bottom of the base block 51 of the propping lid 50 and spaced from one another so as to be easily soldered with cables (not shown). The positioning fillisters 53 are adapted for facilitating the propping lid 50 to be mounted to the insulating housing 10. The casing 46 is sleeved to the tongue portion 12 of the insulating housing 10, with the locking barbs 34 further passing upwards through the top plate 43. The buckling slices 41 are disposed in the indentation areas 17 respectively, and the wedges 15 are buckled in the corresponding buckling openings 411 for fixing the shielding shell 40 and the insulating housing 10 together. The rear of the clamping arm 42 passes through the front of the corresponding fastening cavity 16 of the insulating housing 10 to be received in the receiving recess 522. The locking bump 521 is buckled in the locking hole 421 to fix the shielding shell 40, the insulating housing 10 and the propping lid 50 together. In process of full-automatically manufacturing the plug connector 1, the first positioning portions 33 and the second positioning portions 54 can make the latches 30 and the propping lid 50 properly arranged by a vibrating disk (not shown).

As described above, the propping lid 50 has the insertion bolt 52 protruded from the base block 51 to be inserted in the corresponding fastening cavity 16 of the insulating housing 10, and then the clamping arm 42 of the shielding shell 40 is coupled with the corresponding insertion bolt 52 by means of the locking bump 521 buckled in the locking hole 421. Such structures are excellent to shorten the clamping arm 42, and furthermore, economize manufacture cost of the plug connector 1.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A plug connector, comprising:

an insulating housing having a base body and a tongue portion protruded forwards from a front of the base body, a pair of fastening cavities being opened at two opposite sides of the base body and each extending longitudinally to penetrate through the base body;

a plurality of terminals disposed in the insulating housing respectively;

a propping lid having a base block and a pair of insertion bolts protruded forwards from two opposite ends of a front face of the base block, a locking bump being protruded at a front of an outside of the insertion bolt, the base block being mounted to a rear of the base body of the insulating housing to secure the terminals in the insulating housing, the insertion bolts being inserted in the corresponding fastening cavities; and a shielding shell having a casing sleeved to the tongue portion of the insulating housing, the casing having a top plate, a bottom plate facing the top plate, and two opposite side strips connecting the top plate and the bottom plate, each of the side strips being elongated rearwards to form a clamping arm with a rear being provided with a locking hole, the clamping arm being inserted into a front of the corresponding fastening cavity to be coupled with the corresponding insertion bolt of the propping lid by means of the locking bump buckled in the locking hole.

2. The plug connector as claimed in claim 1, wherein a rear of the fastening cavity is deeper inwards than the front thereof, the insertion bolt has a receiving recess freely opened at the front of the outside thereof, the locking bump is protruded at a substantial middle of the receiving recess, the insertion bolt is inserted in the rear of the fastening cavity with the receiving recess being in alignment with the front of the corresponding fastening cavity, the rear of the clamping arm passes through the front of the fastening cavity to be received in the receiving recess.

3. The plug connector as claimed in claim 1, wherein the base body has two indentation areas oppositely provided at middles of top and bottom surfaces thereof and further enlarged to a front of the base body, a wedge is formed in each indentation area, middles of rear edges of the top plate and the bottom plate are oppositely bent perpendicularly to the top plate and the bottom plate, and then extend rearwards to form a pair of buckling slices, a buckling opening is opened in each of the buckling slices, the buckling slices are disposed in the indentation areas and the wedges are buckled in the corresponding buckling openings for fixing the shielding shell and the insulating housing together.

4. The plug connector as claimed in claim 1, wherein two opposite sides of the base block of the propping lid are concaved inward to form a pair of positioning fillisters for facilitating the propping lid to be mounted to the insulating housing.

5. The plug connector as claimed in claim 1, wherein a positioning portion is protruded at a top of the base block for making the propping lid properly arranged by an external vibrating disk in process of full-automatically manufacturing the plug connector.

6. The plug connector as claimed in claim 1, further comprising a pair of latches disposed in the insulating housing and at two outmost sides of the terminals, each of the latches having a positioning portion for making the latch properly arranged by an external vibrating disk in process of full-automatically manufacturing the plug connector.

* * * * *